US009478851B2

(12) United States Patent
Kuo et al.

(10) Patent No.: US 9,478,851 B2
(45) Date of Patent: Oct. 25, 2016

(54) ANTENNA STRUCTURE

(71) Applicant: Arcadyan Technology Corporation, Hsinchu (TW)

(72) Inventors: Shin-Lung Kuo, Kaosiung (TW); Yi-Cheng Lin, Taipei (TW); Keng-Chih Lin, Taipei (TW); Yu-Hsiang Chang, Yilan County (TW); Shih-Chieh Cheng, Tainan (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 433 days.

(21) Appl. No.: 14/140,117

(22) Filed: Dec. 24, 2013

(65) Prior Publication Data

US 2014/0354504 A1 Dec. 4, 2014

Related U.S. Application Data

(60) Provisional application No. 61/828,240, filed on May 29, 2013.

(51) Int. Cl.

| | |
|---|---|
| ***H01Q 1/48*** | (2006.01) |
| ***H01Q 1/24*** | (2006.01) |
| ***H01Q 9/36*** | (2006.01) |
| ***H01Q 5/392*** | (2015.01) |

(52) U.S. Cl.

CPC ..... *H01Q 1/48* (2013.01); *H01Q 1/243* (2013.01); *H01Q 5/392* (2015.01); *H01Q 9/36* (2013.01)

(58) Field of Classification Search

CPC ..... H01Q 5/392; H01Q 9/36

See application file for complete search history.

(56) References Cited

U.S. PATENT DOCUMENTS

2007/0152885 A1* 7/2007 Sorvala ..... H01Q 1/243 343/700 MS
2008/0204328 A1* 8/2008 Nissinen ..... H01Q 5/00 343/700 MS (Continued)

FOREIGN PATENT DOCUMENTS

CN 102859791 A 1/2013
EP 1198027 A1 4/2002

(Continued)

OTHER PUBLICATIONS

Gyubok Park et al., "The Compact Quad-band Mobile Handset Antenna for the LTE700 MIMO Application" IEEE Antennas and Propagation Society International Symposium, 2009.

(Continued)

*Primary Examiner* — Hoang V Nguyen
*Assistant Examiner* — Michael Bouizza
(74) *Attorney, Agent, or Firm* — Rabin & Berdo, P.C.

(57) ABSTRACT

An antenna structure comprising a substrate and an antenna is provided. The substrate comprises an upper surface and an under surface. The antenna comprises a first metal pattern and a second metal pattern. The first metal pattern is disposed on the upper surface. The first metal pattern comprises a feeding portion and a transmission line connected to the feeding portion. The second metal pattern is disposed on the under surface, and comprises a first parasitic grounding arm, a second parasitic grounding arm, a connecting arm, a grounding plane and a grounding strip. The connecting arm has a parasitic slot, and connects the first parasitic grounding arm and the second parasitic grounding arm. The grounding strip connects the connecting arm and the grounding plane.

19 Claims, 11 Drawing Sheets

(56) References Cited

U.S. PATENT DOCUMENTS

| | | | |
|---|---|---|---|
| 2009/0273521 | A1 | 11/2009 | Wong et al. |
| 2010/0149043 | A1 | 6/2010 | Tsai et al. |
| 2012/0200461 | A1 | 8/2012 | Lee |

FOREIGN PATENT DOCUMENTS

| | | | |
|---|---|---|---|
| EP | 2677596 | A1 | 12/2013 |
| TW | 200947802 | A | 11/2009 |
| WO | WO 02-19671 | A1 | 3/2002 |
| WO | WO 2011-081630 | A1 | 7/2011 |

OTHER PUBLICATIONS

Mohammad Sharawi et al., "A Dual-Element Dual-Band MIMO Antenna System With Enhanced Isolation for Mobile Terminals" IEEE Antennas and Wireless Propagation Letters, vol. 11, pp. 1006-1009, 2012.

Yuan Yao et al., "Design of a compact tri-band planar monopole antenna" Microwave and Millimeter Wave Technology (ICIMMT), vol. 3, 2012.

Chuan-Ling Hu et al., "A Compact Inverted-F Antenna to be Embedded in Ultra-thin Laptop Computer for LTE/WWAN/WiMAX/WLAN Applications" IEEE Antennas and Propagation (APSURSI), pp. 426-429, 2011.

Chan-Woo Yang et al., "Octaband Internal Antenna for 4G Mobile Handset" IEEE Antennas and Wireless Propagation Letters, vol. 10, pp. 817-819, 2011.

Keng-Chih Lin et al., "Simple Printed Multiband Antenna with Novel Parasitic-element Design for Multistandard Mobile Phone Applications" IEEE Antennas and propagation, vol. 61, Issue 1, 2011.

Tran Minh Tuan "Design Dual Band Microstrip Antenna for Next Generation mobile Communication" IEEE International Conference on Advanced Technologies for Communications, pp. 331-335, 2010.

MinSeok Han et al., "Compact Multiband MIMO Antenna for Next Generation USB Dongle Application" IEEE Antennas and Propagation Society International Symposium (APSURSI), 2010.

Minho Kim et al., "Wideband Antenna for Mobile Terminals using a Coupled feeding Structure" IEEE Antennas and Propagation (APSURSI), pp. 1910-1913, 2011.

Chuan-Ling Hu et al., "Compact Multibranch Inverted-F Antenna to be Embedded in a Laptop Computer for LTE/WWAN/IMT-E Applications" IEEE Antennas and Wireless Propagation Letters, vol. 9, pp. 838-841, 2010.

Shih-Hsun Chang et al., "A Broadband LTE/WWAN Antenna Design for Tablet PC" IEEE Transactions on Antennas and Propagation, vol. 60, No. 9, pp. 4354-4359, 2012.

Ting-Wei Kang et al., "Coupled-Fed Shorted Monopole With a Radiating Feed Structure for Eight-Band LTE/WWAN Operation in the Laptop Computer" IEEE Transactions on Antennas and propagation, vol. 59, No. 2, pp. 674-679, Feb. 2011.

Po-Wei Lin et al., "Simple Monopole Slot Antenna for WWAN/LTE Handset Application" Asia-Pacific Microwave Conference Proceedings (APMC), pp. 829-832, 2011.

Mohammad Jan et al., "A 2x1 Compact Dual Band MIMO Antenna System for Wireless Handheld Terminals" IEEE Radio and Wireless Symposium (RWS), pp. 23-26, 2012.

Extended European Search Report dated Oct. 14, 2014.

Taiwanese Office Action dated Mar. 28, 2016.

* cited by examiner

ANTENNA STRUCTURE

This application claims the benefit of U.S. provisional application Ser. No. 61/828,240, field May 29, 2013, the subject matter of which is incorporated herein by reference.

BACKGROUND OF THE INVENTION

1. Field of the Invention

The invention relates in general to an antenna structure.

2. Description of the Related Art

Antenna used for receiving/receiving wireless signals is an essential element in a wireless communication device. The characteristics of antenna, such as radiation efficiency, directionality, frequency band, and impedance matching, have much to do with the efficiency of a wireless communication device. Currently, antenna can be divided into two categories: external antenna and internal antenna. Since the external antenna when colliding with an object may be easily bended or broken, more and more wireless communication devices adopt internal antenna. Since the internal antenna is embedded inside the wireless communication device, the appearance of the wireless communication device is made simpler and compacter. Furthermore, the internal antenna is much safer than the external antenna, which is disposed externally and may be easily bended or broken when colliding with an object, and has become a mainstream product of antenna for wireless communication devices. Therefore, how to provide an antenna structure with excellent efficiency has become a prominent task in the industries.

SUMMARY OF THE INVENTION

The invention is directed to an antenna structure.

According to the present invention, an antenna structure is provided. The antenna structure comprises a substrate and the antenna. The substrate comprises an upper surface and an under surface. The upper surface is opposite to the under surface. The antenna comprises a first metal pattern and a second metal pattern electrically coupled to the first metal pattern. The first metal pattern is disposed on the upper surface, and comprises a feeding portion and a transmission line connected to the feeding portion. The second metal pattern is disposed on the under surface, and comprises a first parasitic grounding arm, a second parasitic grounding arm, a connecting arm, a grounding plane and a grounding strip. The connecting arm has a parasitic slot, and connects the first parasitic grounding arm and the second parasitic grounding arm. The grounding strip connects the connecting arm and the grounding plane.

According to an antenna structure provided in the present invention, a non-metal region is formed between the connecting arm and the grounding plane and between the grounding plane and one of the first parasitic grounding arm and the second parasitic grounding arm, and the grounding strip passes through the non-metal region and connects the connecting arm and the grounding plane.

According to an antenna structure provided in the present invention, the first parasitic grounding arm comprises a first bend and a first extending arm. The second parasitic grounding arm comprises a second bend and a second extending arm. The first extending arm and the second extending arm, disposed oppositely but not connected to each other, form an opening, so that the first parasitic grounding arm, the second parasitic grounding arm and the connecting arm form a semi-closed region being another non-metal region, and the projection of the feeding portion is located at the center of the semi-closed region.

According to an antenna structure provided in the present invention, the second metal pattern further comprises an extending arm. The extending arm is connected to the first parasitic grounding arm and extended towards the second parasitic grounding arm from the first parasitic grounding arm so as to be adjoining to the projection of the feeding portion.

According to the present invention, another antenna structure is provided. The antenna structure comprises a substrate and an antenna. The substrate comprises an upper surface and an under surface opposite to the upper surface. The antenna comprises a first metal pattern, a second metal pattern, a third metal pattern, and a fourth metal pattern. The first metal pattern is electrically coupled to the second metal pattern. The third metal pattern is electrically coupled to the fourth metal pattern. The first metal pattern and the third metal pattern are disposed on the upper surface. The first metal pattern comprises a feeding portion and a transmission line connected to the feeding portion. The structure of the third metal pattern is equivalent to that of the first metal pattern. The second metal pattern and the fourth metal pattern are disposed on the under surface. The second metal pattern comprises a first parasitic grounding arm, a second parasitic grounding arm, a connecting arm, a grounding plane and a grounding strip. The connecting arm has a parasitic slot, and connects the first parasitic grounding arm and the second parasitic grounding arm. The structure of the fourth metal pattern is equivalent to that of the second metal pattern. The grounding strip connects the connecting arm and the grounding plane. The first metal pattern and the third metal pattern mirror-duplex each other and are disposed on the upper surface. The second metal pattern and the fourth metal pattern mirror-duplex each other and are disposed on the under surface.

According to another antenna structure disclosed in the present invention, the first metal pattern and the third metal pattern are perpendicular to each other and are disposed on the upper surface, and the second metal pattern and the fourth metal pattern are perpendicular to each other and are disposed on the under surface.

According to another antenna structure disclosed in the present invention, the grounding plane adjoining to the second metal pattern and the fourth metal pattern disposed oppositely has a decoupling slot extended towards the grounding plane from the non-metal region.

The above and other aspects of the invention will become better understood with regard to the following detailed description of the preferred but non-limiting embodiment (s). The following description is made with reference to the accompanying drawings.

DETAILED DESCRIPTION OF THE INVENTION

First Embodiment

Figure 1:
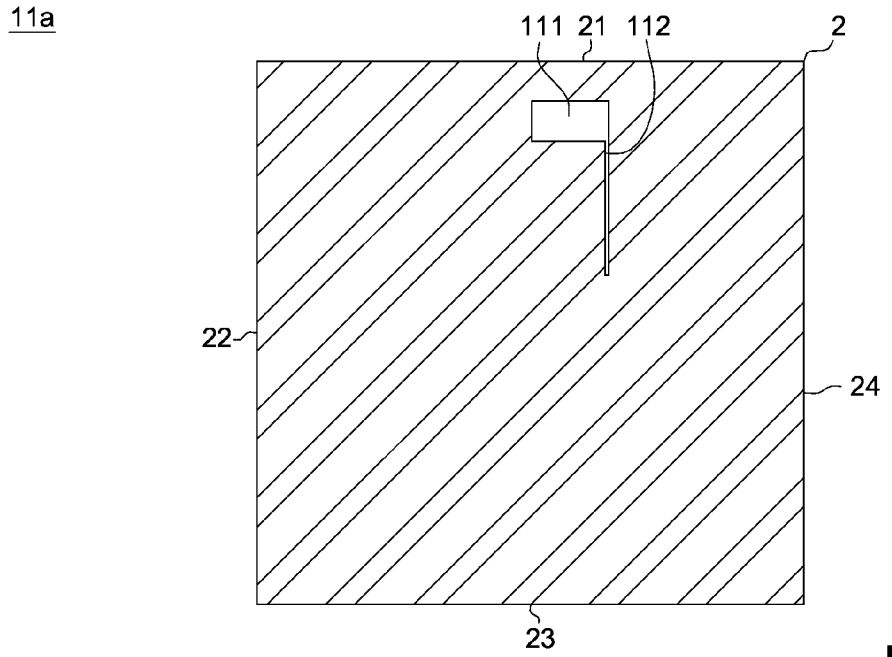
FIG. 1 is a schematic diagram of a metal pattern on an upper surface according a first embodiment.
Figure 2:
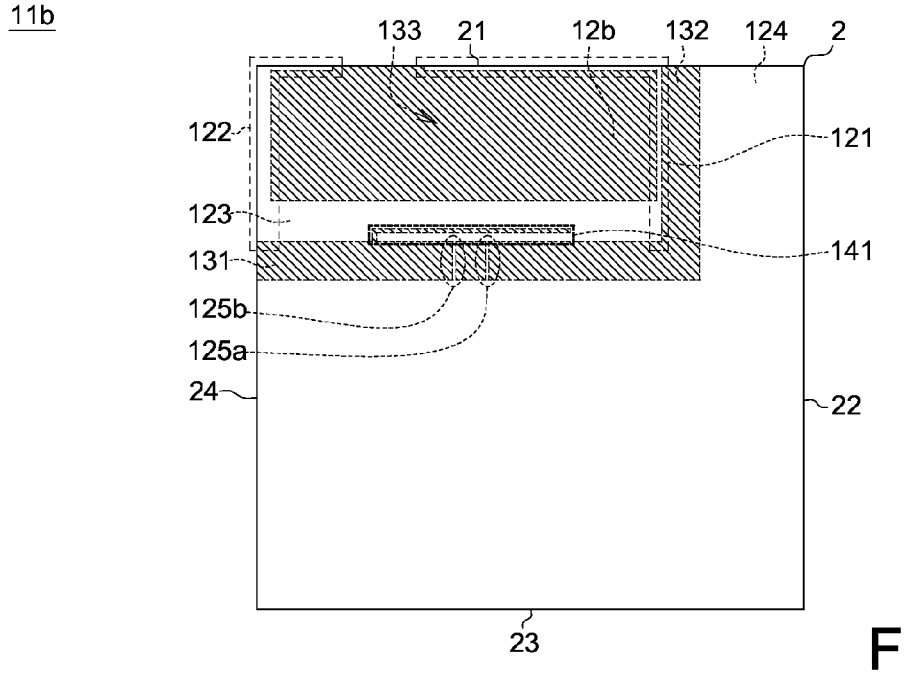
FIG. 2 is a schematic diagram of a metal pattern on an under surface according a first embodiment.
Figure 3:
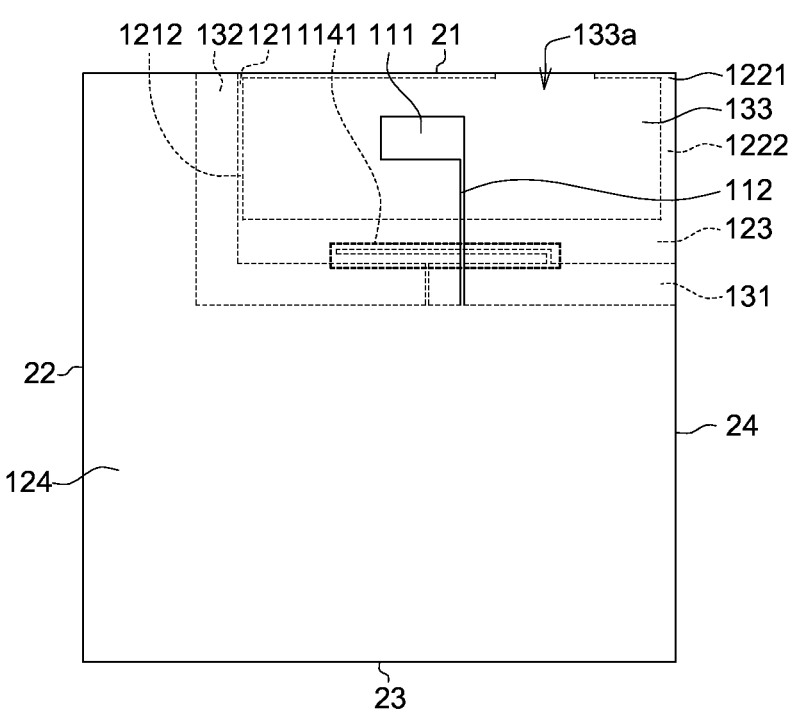
FIG. 3 is a perspective diagram of an antenna structure according a first embodiment.
Figure 4:
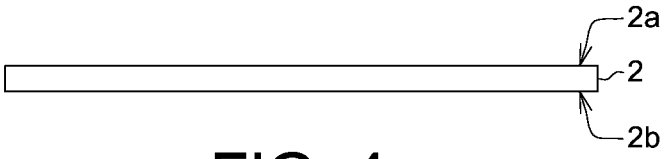
FIG. 4 is a side view of a substrate.

Referring to FIG. 1, FIG. 2, FIG. 3 and FIG. 4. FIG. 1 is a schematic diagram of a metal pattern on an upper surface according a first embodiment. FIG. 2 is a schematic diagram of a metal pattern on an under surface according a first embodiment. FIG. 3 is a perspective diagram of an antenna structure according a first embodiment. FIG. 4 is a side view of a substrate. The antenna structure, such as a long term evolution (LTE) antenna capable of operating in several frequency bands, comprises a substrate 2 and an antenna 1. The substrate 2 comprises a substrate side 21, a substrate side 22, a substrate side 23, a substrate side 24, an upper surface 2*a* and an under surface 2*b*. The upper surface 2*a* is opposite to the under surface 2*b*. The substrate side 21 is opposite to the substrate side 23. The substrate side 22 is opposite to the substrate side 24. The substrate side 22 connects the substrate side 21 and the substrate side 23. The substrate side 24 connects the substrate side 21 and the substrate side 23. The antenna 1 comprises a metal pattern 11*a* and a metal pattern 11*b* electrically coupled to the metal pattern 11*a*. The metal pattern 11*a* is disposed on the upper surface 2*a*, and the metal pattern 11*b* is disposed on the under surface 2*b*.

The metal pattern 11*a* comprises a feeding portion 111 and a transmission line 112, and one terminal of the transmission line 112 connects the feeding portion 111. The metal pattern 11*b* comprises a parasitic grounding arm 121, a parasitic grounding arm 122, a connecting arm 123, a grounding plane 124, a grounding strip 125*a*, and a grounding strip 125*b*. The transmission line 112 is set across the connecting arm 123. The connecting arm 123 has a parasitic slot 141, and connects the parasitic grounding arm 121 and the parasitic grounding arm 122. The grounding strip 125*a* and the grounding strip 125*b* connect the connecting arm 123 and the grounding plane 124, and the grounding strip 125*a* is parallel to the grounding strip 125*b*.

Furthermore, the parasitic grounding arm 121 and the parasitic grounding arm 122 are L-shaped and disposed oppositely. After the parasitic grounding arm 121 is extended towards the connecting arm 123 from one terminal of the substrate side 21, the parasitic grounding arm 121 is further extended towards the substrate side 24. After the parasitic grounding arm 122 is extended towards the substrate side 21 from the other terminal of the connecting arm 123, the parasitic grounding arm 122 is further extended towards the substrate side 22. A non-metal region 133 opposite to the feeding portion 111 is formed between the parasitic grounding arm 121 and the connecting arm 123.

A non-metal region 132 is formed between the connecting arm 123 and the grounding plane 124 and between the parasitic grounding arm 121 and the grounding plane 124. A non-metal region 131 is formed between the connecting arm 123 and the grounding plane 124 and between the parasitic grounding arm 122 and the grounding plane 124. The grounding strip 125*a* passes through the non-metal region 131 or the non-metal region 132 and connects the connecting arm 123 and the grounding plane 124.

The parasitic grounding arm 121 comprises a bend 1211 and an extending arm 1212. The parasitic grounding arm 122 comprises a bend 1221 and an extending arm 1222. The extending arm 1211 and the extending arm 1222, disposed oppositely but not connected to each other, form an opening 133*a*, so that the parasitic grounding arm 121, the parasitic grounding arm 122 and the connecting arm 123 form a semi-closed region being a non-metal region 133, and the projection of the feeding portion 111 is located at the center of the semi-closed region.

In the first embodiment, the parasitic slot 141 is exemplified by an L-shape, and is extended towards the connecting arm 123 from the non-metal region 131. After the parasitic slot 141 is extended towards the substrate side 21 from the non-metal region 131, the parasitic slot 141 is further extended towards the substrate side 22.

Figure 5:
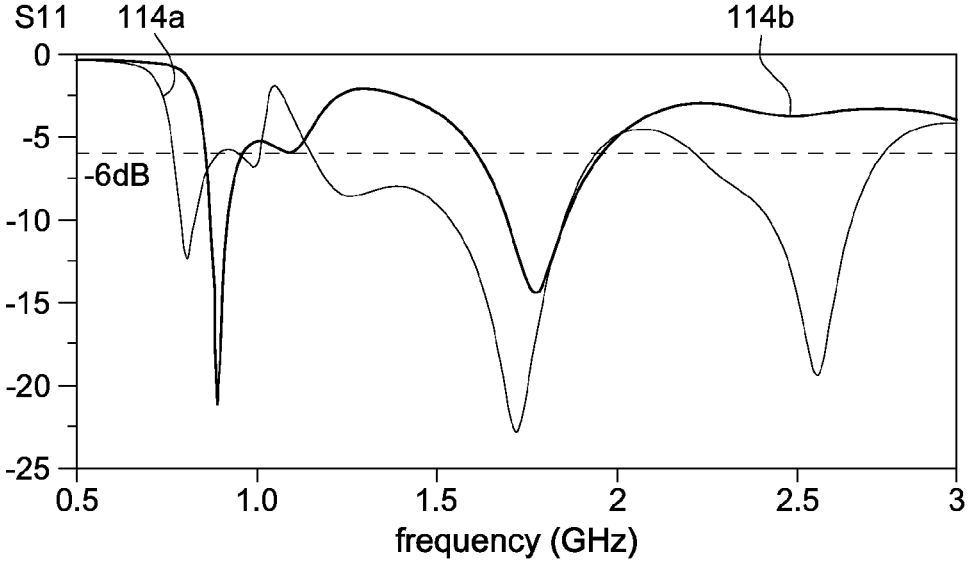
FIG. 5 is a schematic diagram of return loss with parasitic slot but without parasitic slot.

Referring to FIG. 5, a schematic diagram of return loss with parasitic slot but without parasitic slot is shown. Curve 114*a* illustrates return loss S11 with parasitic slot, and curve 114*b* illustrates return loss S11 without parasitic slot. As indicated in FIG. 5, it is obvious that the parasitic slot can additionally sense a resonant band (LTE 2300/2500) of 2.3 GHz~2.7 GHz. Judging from the frequency band (DSC-1800) of 1.71 GHz~1.88 GHz, it is obvious that the return loss S11 with parasitic slot is lower than the return loss S11 without parasitic slot. In addition, judging from the frequency band (LTE-800) of 790 MHz~870 MHz, it is obvious that the return loss S11 with parasitic slot is lower than the return loss S11 without parasitic slot.

Figure 6:
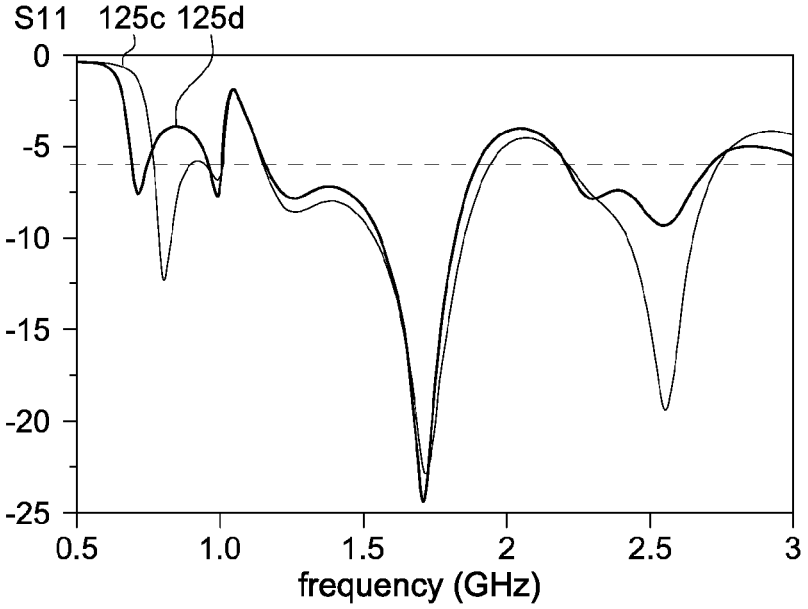
FIG. 6 is a schematic diagram of return loss with grounding strip but without grounding strip.

Referring to FIG. 6, a schematic diagram of return loss with grounding strip but without grounding strip is shown. Curve 125*c* illustrates return loss S11 with grounding strip. Curve 125*d* illustrates return loss S11 without grounding strip. Judging from the frequency band of 2.3 GHz~2.7 GHz, it is obvious that the return loss S11 with grounding strip is lower than the return loss S11 without grounding strip. Moreover, judging from the frequency band of 790 MHz~870 MHz, it is obvious that the return loss S11 with grounding strip is lower than return loss S11 without grounding strip.

Figure 7:
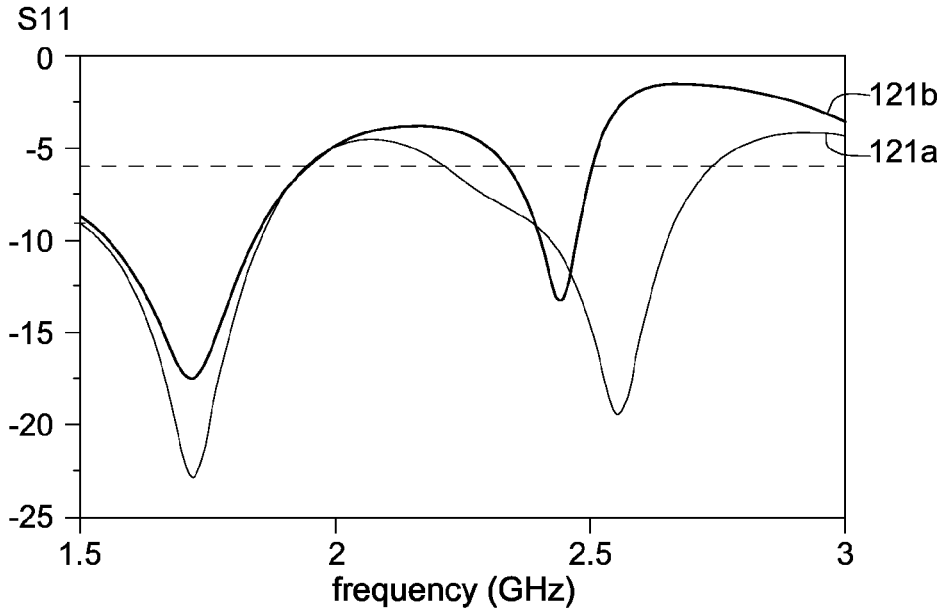
FIG. 7 is a schematic diagram of return loss with parasitic grounding arm but without parasitic grounding arm.

Referring to FIG. 7, a schematic diagram of return loss with parasitic grounding arm but without parasitic grounding arm is shown. Curve 121*a* illustrates return loss S11 with parasitic grounding arm, and curve 121*b* illustrates return loss S11 without parasitic grounding arm. Judging from the frequency band of 2.3 GHz~2.7 GHz, it is obvious that the return loss S11 with parasitic grounding arm is lower than return loss S11 without parasitic grounding arm. Also, judging from the frequency band of 1.71 GHz~1.88 GMHz, it is obvious that the return loss S11 with parasitic grounding arm is lower than return loss S11 without parasitic grounding arm.

Figure 8:
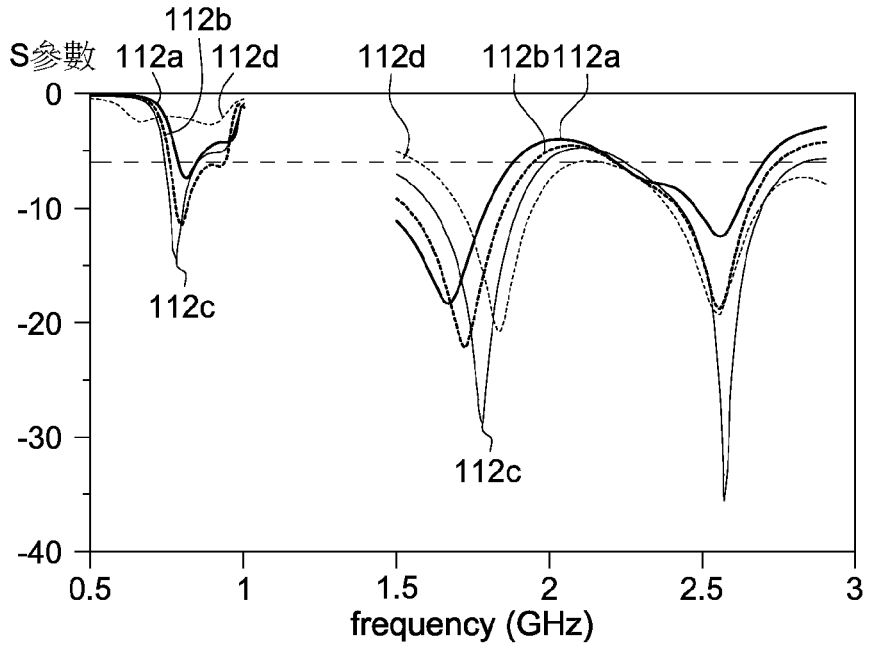
FIG. 8 is a schematic diagram of parameter S of a transmission line with different lengths.

Referring to FIG. 8, a schematic diagram of parameter S of a transmission line with different lengths is shown. Curve 112*a* illustrates parameter S of a 5 mm transmission line. Curve 112*b* illustrates parameter S of a 7 mm transmission line. Curve 112*b* illustrates parameter S of a 9 mm transmission line. Curve 112*d* illustrates parameter S of a 12 mm transmission line. It can be seen from FIG. 8 that the antenna structure of the present invention can achieve better impedance matching by adjusting the length of the transmission line.

Second Embodiment

Figure 9:
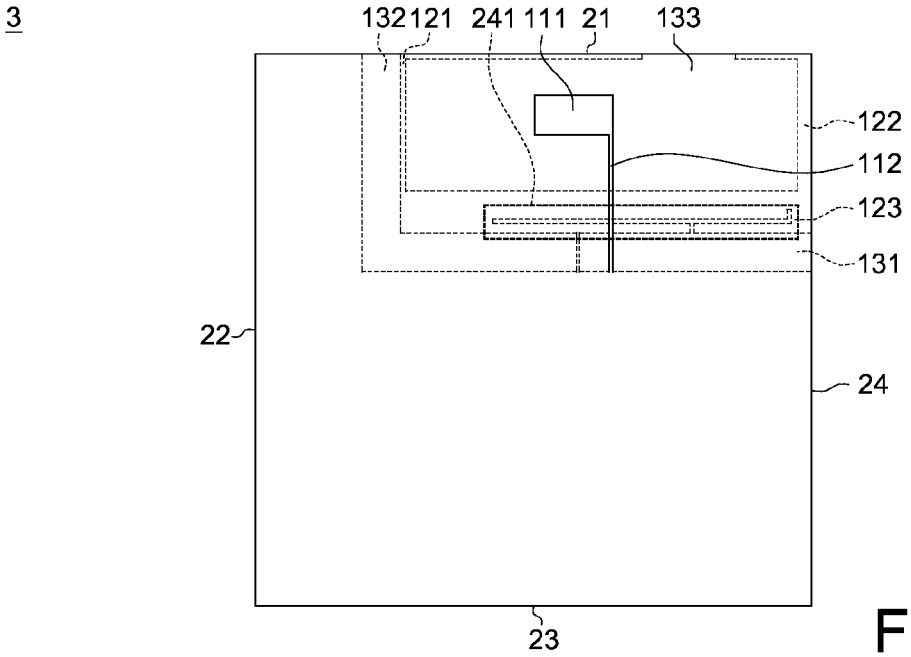
FIG. 9 is a perspective diagram of an antenna structure according a second embodiment.

Referring to FIG. 3 and FIG. 9. FIG. 9 is a perspective diagram of an antenna structure according a second embodiment. The second embodiment is different from the first embodiment mainly in that the parasitic slot 241 and the parasitic slot 141 of the antenna 3 have different shapes. After the parasitic slot 241 is extended towards the substrate side 21 from the non-metal region 131, the parasitic slot 241 is further extended the substrate side 22 and the substrate side 24 in sequence. After the parasitic slot 241 is extended towards the substrate side 24, the parasitic slot 241 is further extended towards the substrate side 21.

Third Embodiment

Figure 10:
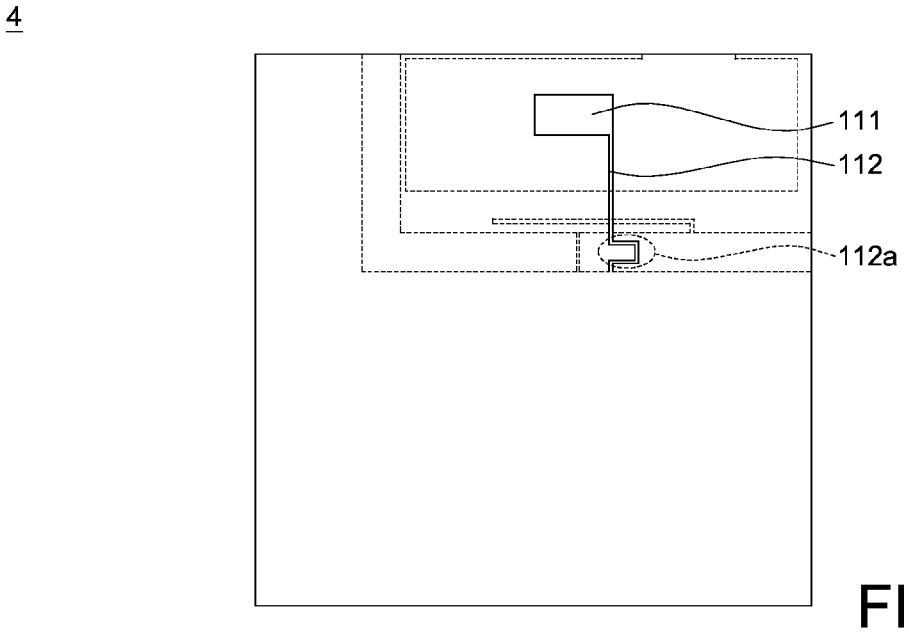
FIG. 10 is a perspective diagram of an antenna structure according a third embodiment.

Referring to FIG. 10, a perspective diagram of an antenna structure according a third embodiment is shown. The third embodiment is different from the first embodiment mainly in that the transmission line 112 of the antenna 4 comprises a bend 112*a*. Through the bend 112*a*, the antenna 4 can perform impedance matching to improve the impedance of the imaginary part, so that the matching circuit can be dispensed with. For convenience of description, the third embodiment is exemplified by a bend, but the invention is not limited thereto. The number of bends in the transmission line 112 can be adjusted according to design needs and actual situations.

Fourth Embodiment

Figure 11:
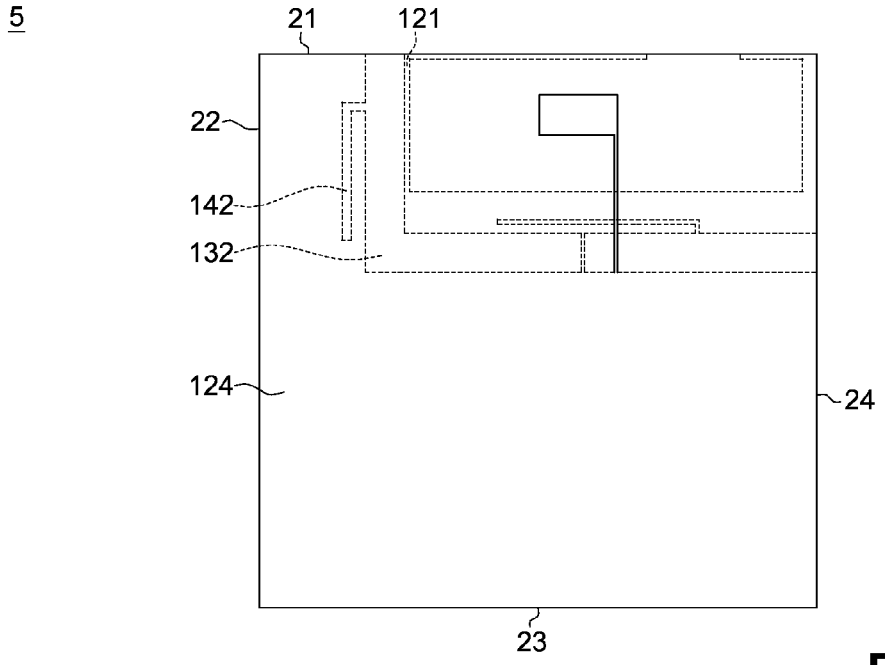
FIG. 11 is a perspective diagram of an antenna structure according a fourth embodiment.
Figure 12:
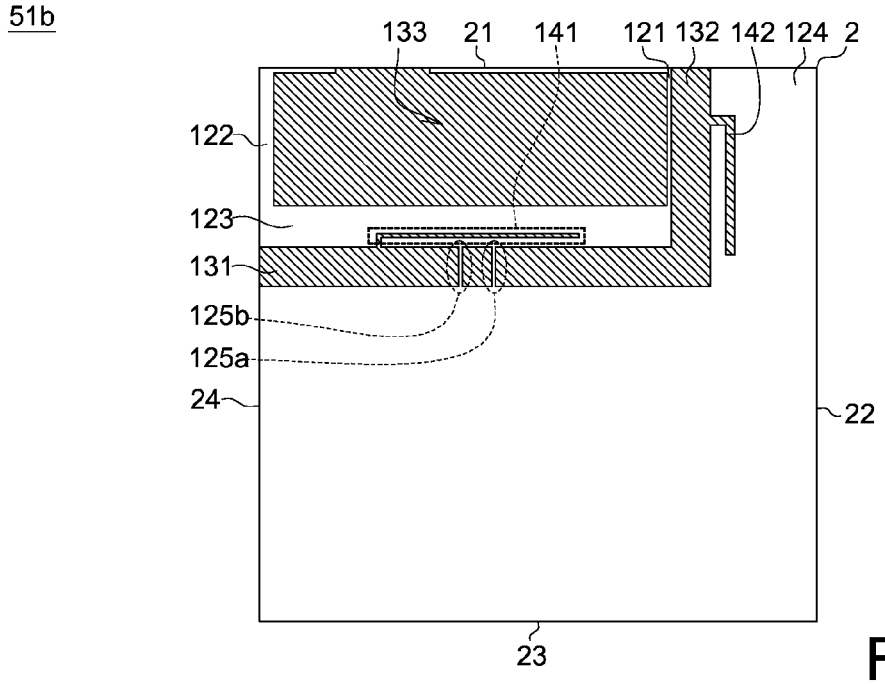
FIG. 12 is a schematic diagram of a metal pattern on an under surface according a fourth embodiment.

Referring to FIG. 4, FIG. 11 and FIG. 12. FIG. 11 is a perspective diagram of an antenna structure according a fourth embodiment. FIG. 12 is a schematic diagram of a metal pattern on an under surface according a fourth embodiment. The fourth embodiment is different from the first embodiment mainly in that in the antenna 5, the grounding plane 142 of the metal pattern 51*b* on the under surface 2*b* has an L-shaped decoupling slot 142. The metal pattern on the upper surface 2*b* of the antenna 5 is equivalent to the metal pattern 11*a* of the first embodiment. A non-metal region 132 is formed between the parasitic grounding arm 121 and the grounding plane 124. The decoupling slot 142 is extended towards the grounding plane 124 from the non-metal region 132. Furthermore, after the decoupling slot 142 is extended towards the substrate side 22 from the non-metal region 132, the decoupling slot 142 is further extended towards the substrate side 23.

Fifth Embodiment

Figure 13:
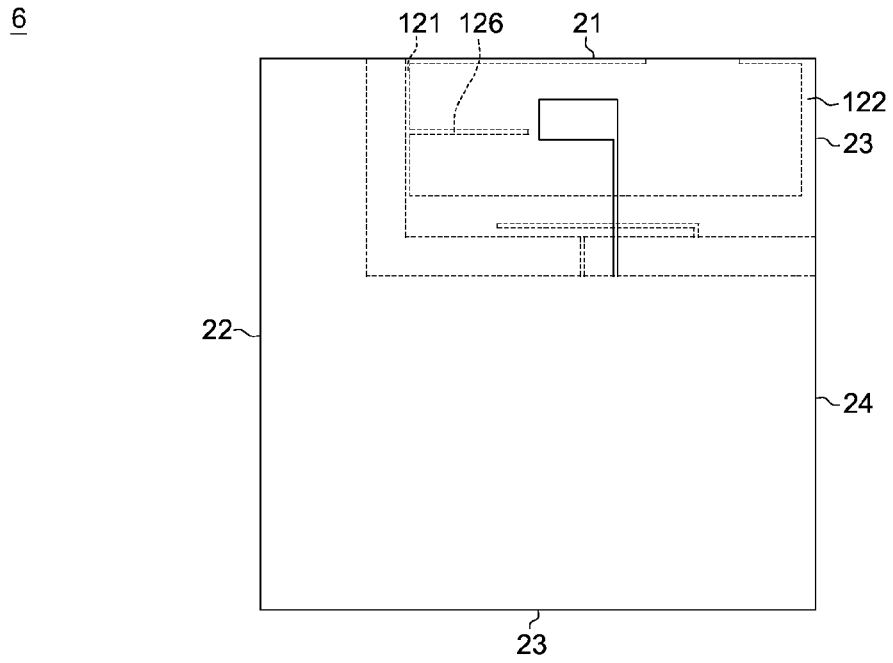
FIG. 13 is a perspective diagram of an antenna structure according a fifth embodiment.
Figure 14:
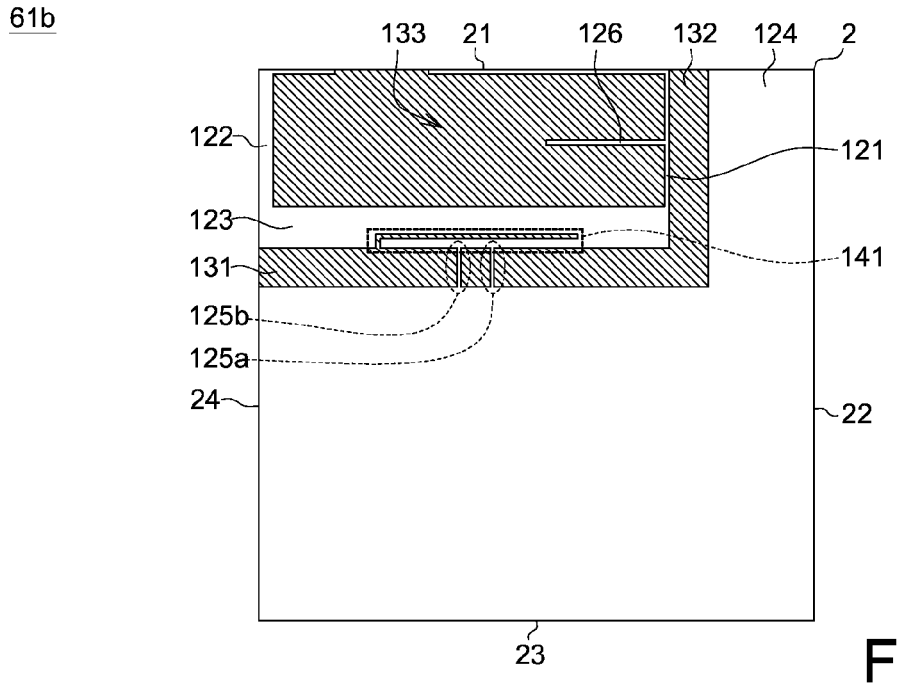
FIG. 14 is a schematic diagram of a metal pattern on an under surface according a fifth embodiment.

Referring to FIG. 4, FIG. 13 and FIG. 14. FIG. 13 is a perspective diagram of an antenna structure according a fifth embodiment. FIG. 14 is a schematic diagram of a metal pattern on an under surface according a fifth embodiment. The fifth embodiment is different from the first embodiment mainly in that in the antenna 6, the metal pattern 61*b* on the under surface 2*b* further comprises an extending arm 126 extended towards the second parasitic grounding arm 122 from the parasitic grounding arm 121 and adjoining to the projection of the feeding portion 111.

Sixth Embodiment

Figure 15:
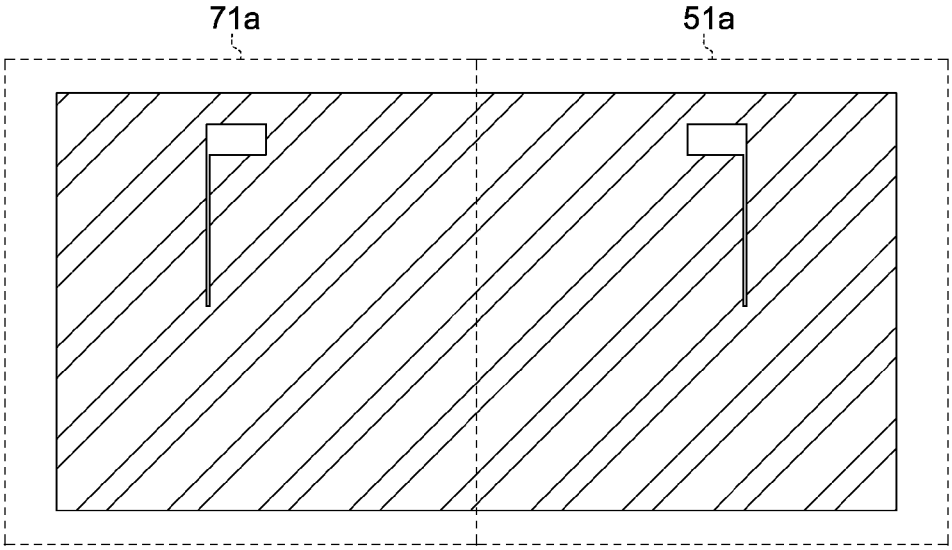
FIG. 15 is a schematic diagram of a metal pattern on an upper surface according a sixth embodiment.
Figure 16:
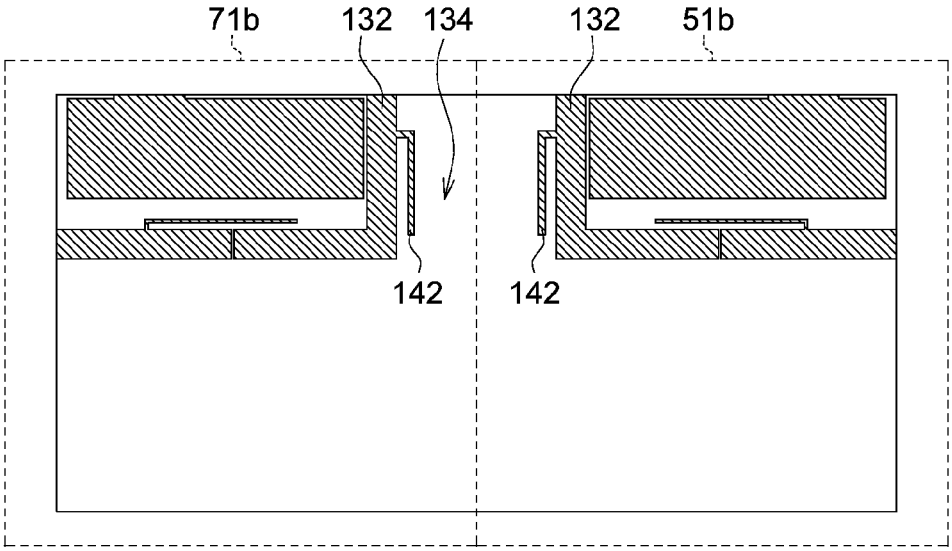
FIG. 16 is a schematic diagram of a metal pattern on an under surface according a sixth embodiment.
Figure 17:
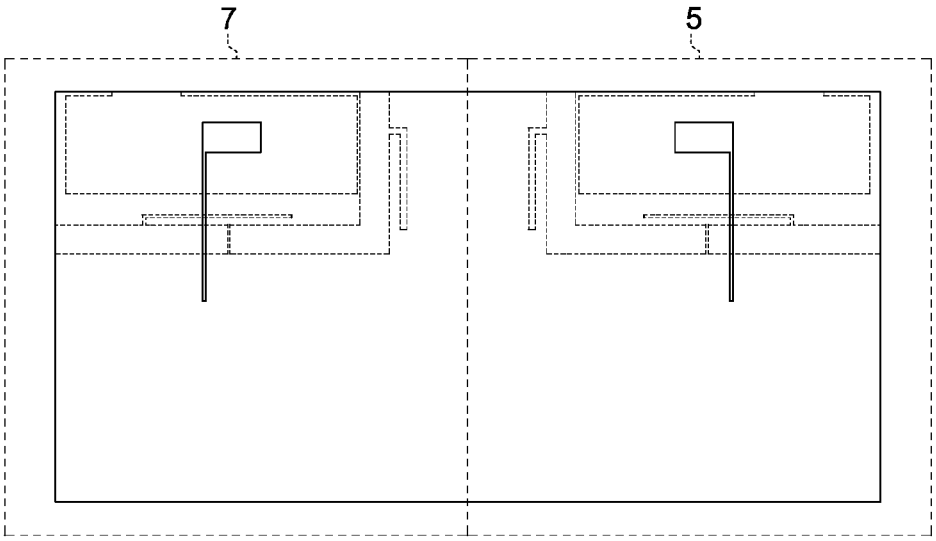
FIG. 17 is a perspective diagram of an antenna structure according a sixth embodiment.

Referring to FIG. 4, FIG. 15, FIG. 16 and FIG. 17. FIG. 15 is a schematic diagram of a metal pattern on an upper surface according a sixth embodiment. FIG. 16 is a schematic diagram of a metal pattern on an under surface according a sixth embodiment. FIG. 17 is a perspective diagram of an antenna structure according a sixth embodiment. The sixth embodiment is different from the fourth embodiment mainly in that the antenna structure further comprises an antenna 7 in addition to the antenna 5. The antenna 7 comprises a metal pattern 71*a* and a metal pattern 71*b*. The structure of the metal pattern 71*a* is equivalent to that of the metal pattern 51*a*. The metal pattern 71*a* and the metal pattern 51*a* mirror-duplex each other and are disposed on the upper surface 2*a*. The structure of the metal pattern 71*b* is equivalent to that of the metal pattern 51*b*. The metal pattern 71*a* is electrically coupled to the metal pattern 71*b*. The metal pattern 51*b* and metal pattern 71*b* are adjoining to an interval region 134 of the grounding plane 124. The grounding plane 124 has a decoupling slot 142 extended towards the grounding plane 124 from the non-metal region 132.

Figure 18:
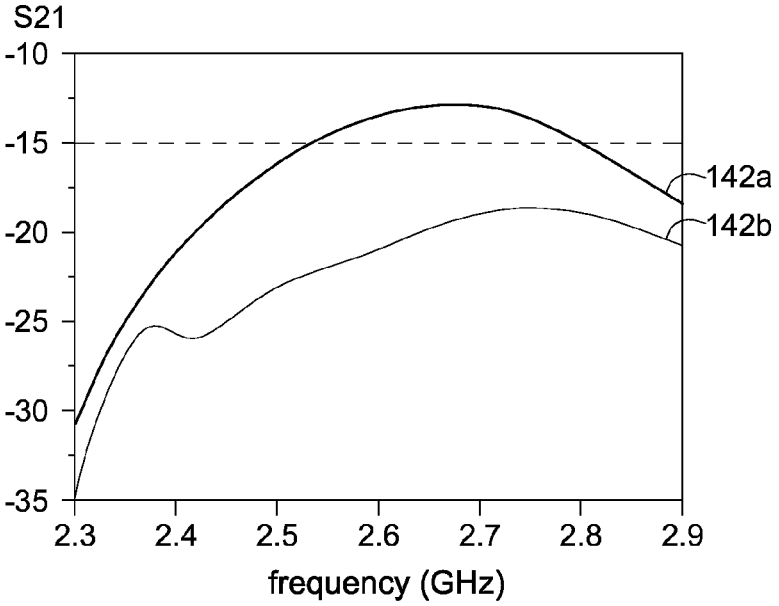
FIG. 18 is a schematic diagram of isolation with decoupling slot but without decoupling slot.

Referring to FIG. 18, a schematic diagram of isolation with decoupling slot but without decoupling slot is shown. Curve 142*a* illustrates the isolation with decoupling slot, and curve 142*b* illustrates the isolation without decoupling slot. As indicated in FIG. 12, judging from the frequency band of 2.3 GHz~2.9 GHz, it is obvious that the isolation with decoupling slot is higher than the isolation without decoupling slot.

Seventh Embodiment

Figure 19:
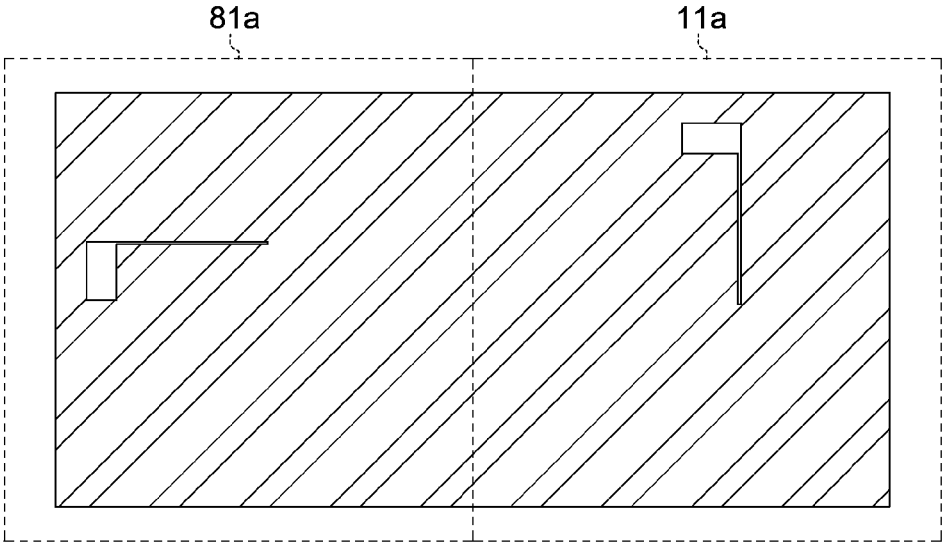
FIG. 19 is a schematic diagram of a metal pattern on an upper surface according a seventh embodiment.
Figure 20:
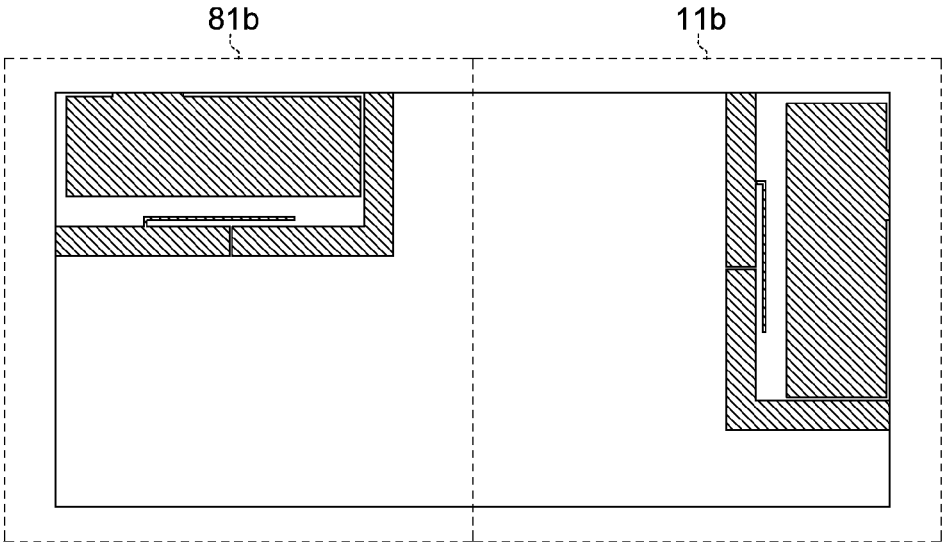
FIG. 20 is a schematic diagram of a metal pattern on an under surface according to a seventh embodiment.
Figure 21:
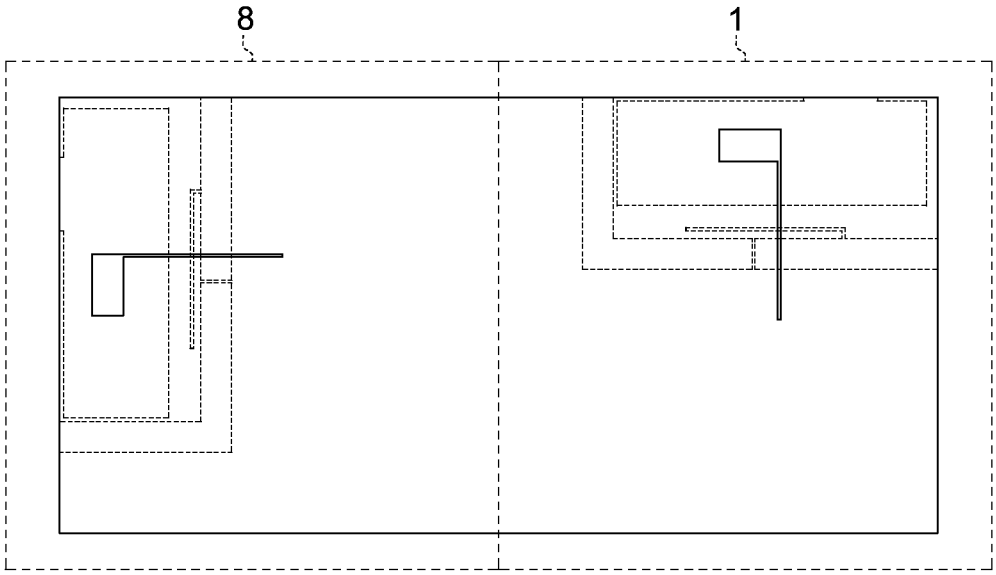
FIG. 21 is a perspective diagram of an antenna structure according a seventh embodiment.

Referring to FIG. 4, FIG. 19, FIG. 20 and FIG. 21. FIG. 19 is a schematic diagram of a metal pattern on an upper surface according a seventh embodiment. FIG. 20 is a schematic diagram of a metal pattern on an under surface according to a seventh embodiment. FIG. 21 is a perspective diagram of an antenna structure according a seventh embodiment. The seventh embodiment is different from the first embodiment mainly in that the antenna structure further comprises an antenna 8 in addition to the antenna 1. The antenna 8 comprises a metal pattern 81*a* and a metal pattern 81*b*. The structure of the metal pattern 81*a* is equivalent to that of the metal pattern 11. The metal pattern 81*a* and the metal pattern 11*a* are perpendicular to each other and are disposed on the upper surface 2*a*. The structure of the metal pattern 81*b* is equivalent to that of the metal pattern 11*b*. The metal pattern 81*b* and the metal pattern 11*b* are perpendicular to each other and are disposed on the under surface 2*b*.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna structure, comprising:

a substrate, comprising an upper surface and an under surface opposite to the upper surface; and a first antenna, comprising:

a first metal pattern disposed on the upper surface and comprising:

a feeding portion; and a transmission line connected to the feeding portion; and a second metal pattern disposed on the under surface and electrically coupled to the first metal pattern, wherein the second metal pattern comprises:

a first parasitic grounding arm;

a second parasitic grounding arm;

a connecting arm having a parasitic slot and connecting the first parasitic grounding arm and the second parasitic grounding arm;

a grounding plane; and a first grounding strip connecting the connecting arm and the grounding plane;

wherein the substrate further comprises a first substrate side, a second substrate side, a third substrate side and a fourth substrate side, the first substrate side is opposite to the third substrate side, the second substrate side is opposite to the fourth substrate side, and the parasitic slot extends towards the first substrate side from a non-metal region and further extended towards the second substrate side.

2. The antenna structure according to claim 1, wherein the first parasitic grounding arm and the second parasitic grounding arm are L-shaped and disposed oppositely.

3. The antenna structure according to claim 2, wherein the first parasitic grounding arm is extended towards the first substrate side from one terminal of the connecting arm and further extended towards the fourth substrate side, and the second parasitic grounding arm is extended towards the first substrate side from the other terminal of the connecting arm and further extended towards the second substrate side.

4. The antenna structure according to claim 1, wherein the non-metal region is formed between the connecting arm and the grounding plane and between the grounding plane and one of the first parasitic grounding arm and the second parasitic grounding arm, the first grounding strip passes through the non-metal region and connects the connecting arm and the grounding plane, and the parasitic slot is extended towards the connecting arm from the non-metal region.

5. The antenna structure according to claim 1, wherein the parasitic slot is L-shaped.

6. The antenna structure according to claim 1, wherein after the parasitic slot is extended towards the first substrate side from the non-metal region, the parasitic slot is further extended towards the fourth substrate side, and after the parasitic slot is extended towards the fourth substrate side, the parasitic slot is further extended towards the first substrate side.

7. The antenna structure according to claim 1, wherein the second metal pattern further comprises:

a second grounding strip parallel to the first grounding strip and connecting the connecting arm and the grounding plane.

8. The antenna structure according to claim 1, wherein the transmission line is set across the connecting arm.

9. The antenna structure according to claim 8, wherein the transmission line comprises at least a bend.

10. The antenna structure according to claim 4, wherein the grounding plane has an L-shaped decoupling slot.

11. The antenna structure according to claim 10, wherein the decoupling slot is extended towards the grounding plane from the non-metal region.

12. The antenna structure according to claim 11, wherein the decoupling slot extends towards the second substrate side from the non-metal region and further extended towards the third substrate side.

13. The antenna structure according to claim 1, wherein the second metal pattern further comprises an extending arm extended towards the second parasitic grounding arm from the first parasitic grounding arm and adjoining to the projection of the feeding portion.

14. The antenna structure according to claim 1, wherein the non-metal region opposite to the feeding portion is formed among the first parasitic grounding arm, the second parasitic grounding arm and the connecting arm.

15. The antenna structure according to claim 1, further comprising:

a second antenna, comprising:

a third metal pattern whose structure is equivalent to that of the first metal pattern, wherein the third metal pattern and the first metal pattern mirror-duplex each other and are disposed on the upper surface; and a fourth metal pattern whose structure is equivalent to that of the second metal pattern, wherein the fourth metal pattern and the second metal pattern mirror-duplex each other and are disposed on the under surface, and the third metal pattern is electrically coupled to the fourth metal pattern.

16. The antenna structure according to claim 15, wherein the non-metal region is formed between the connecting arm and the grounding plane and between the grounding plane and one of the first parasitic grounding arm and the second parasitic grounding arm, the first grounding strip passes through the non-metal region and connects the connecting arm and the grounding plane, the second metal pattern and the fourth metal pattern are adjoining to an interval region of the grounding plane, and the grounding plane has a decoupling slot extended towards the grounding plane from the non-metal region.

17. The antenna structure according to claim 1, further comprising:

a second antenna, comprising:

a third metal pattern whose structure is equivalent to that of the first metal pattern, wherein the third metal pattern and the first metal pattern are perpendicular to each other and are disposed on the upper surface; and a fourth metal pattern whose structure is equivalent to that of the second metal pattern, wherein the fourth metal pattern and the second metal pattern are perpendicular to each other and are disposed on the under surface.

18. The antenna structure according to claim 1, wherein the non-metal region is formed between the connecting arm and the grounding plane and between the grounding plane and one of the first parasitic grounding arm and the second parasitic grounding arm, and the first grounding strip passes through the non-metal region and connects the connecting arm and the grounding plane.

19. The antenna structure according to claim 1, wherein the first parasitic grounding arm comprises a first bend and a first extending arm, the second parasitic grounding arm comprises a second bend and a second extending arm, the first extending arm and the second extending arm, disposed oppositely but not connected to each other, form an opening, so that the first parasitic grounding arm, the second parasitic grounding arm and the connecting arm form a semi-closed region being another non-metal region, and the projection of the feeding portion is located at the center of the semi-closed region.

* * * * *